US006348024B1

(12) United States Patent
Hwang

(10) Patent No.: US 6,348,024 B1
(45) Date of Patent: Feb. 19, 2002

(54) TREAD EXERCISING MACHINE

(76) Inventor: Jyh-Yeuan Hwang, No. 89-1, Hsin-Pu Li, Tung-Hsiao Chen, Miao-Li Hsien (TW)

( * ) Notice: Subject to any disclaimer, the term of this patent is extended or adjusted under 35 U.S.C. 154(b) by 0 days.

(21) Appl. No.: 09/811,475

(22) Filed: Mar. 20, 2001

(51) Int. Cl.[7] ..... A63B 22/00; A63B 22/02
(52) U.S. Cl. ..... 482/52; 482/54; 482/35
(58) Field of Search ..... 482/35, 36, 37, 482/51, 52, 53, 54; 119/700; 248/925; D21/670

(56) References Cited

U.S. PATENT DOCUMENTS 4,726,581 A * 2/1988 Chang ..... 482/53
5,328,420 A * 7/1994 Allen ..... 482/52
5,328,422 A * 7/1994 Nichols ..... 482/52
5,352,166 A * 10/1994 Chang ..... 482/52
5,556,352 A * 9/1996 Chang ..... 482/52
5,769,759 A * 6/1998 Alter et al. ..... 482/37
6,095,952 A * 8/2000 Ali et al. ..... 482/54

* cited by examiner

*Primary Examiner*—Stephen R. Crow
(74) *Attorney, Agent, or Firm*—Rosenberg, Klein & Lee

(57) ABSTRACT

The present invention relates to a tread exercising machine including two opposite side walls each pre-fit with a cam groove and a chain guide groove having a symmetrical track, and each having two ends pivoted with a shaft driven by a chain. A plurality of serially arranged steps are mounted between the two side walls. Each of the steps has two end faces each provided with a protruding shaft and a retaining shaft respectively. The protruding shaft is inserted into the cam groove of the side wall, and the retaining shaft is combined with the chain. In such a manner, the steps produce predetermined recycling action along the track of the cam groove, so that the tread exercising machine can perform the mountain climbing effect and the walking effect. In addition, the steps are acted fluently.

3 Claims, 8 Drawing Sheets

TREAD EXERCISING MACHINE

BACKGROUND OF THE INVENTION

1. Field of the Invention

The present invention relates to a tread exercising machine, and more particularly to a tread exercising machine that can be used to perform the exercising action of mountain climbing and walking.

2. Description of the Related Prior Art

The closest prior art of which the applicant is aware is disclosed in the Taiwanese Patent Application serial No. 89214245, entitled "MOUNTAIN CLIMBING MACHINE". In the patent application, the mountain climbing machine comprises two opposite side plates 10, and a plurality of steps 20 mounted between the two side plates 10. Each side plate 10 defines a guide groove 11 whose outer periphery is provided with a guide plate 12. Each side plate 10 has two ends each secured with a bearing seat 13 for insertion of a bearing 131. A drive shaft 50 is mounted between two bearings 131. The drive shaft 50 has two ends each respectively combined with a drive wheel 30 which is rotated by a drive motor 40. Each step 20 has two ends each mounted with a linking shaft 21 and a guide rod 22. The linking shafts 21 of each step 20 are connected by a connecting rod 211 so that the steps 20 are connected with each other. The linking shaft 21 is driven by the drive wheel 30. The guide rod 22 of each step 20 has an outer end received in the guide groove 11 of the side plate 10, so that each step 20 can be moved along the track of the guide groove 11, whereby the steps 20 are moved downward from the upper position of the side plates 10, such that the user can tread the steps 20 to move upward, thereby forming the exercising action like climbing the mountain.

SUMMARY OF THE INVENTION

The primary objective of the present invention is to provide a tread exercising machine that can achieve the exercising effects of climbing the mountain and walking.

Another objective of the present invention is to provide a tread exercising machine, wherein each step can be linked and moved fluently.

In accordance with the present invention, there is provided a tread exercising machine comprising: two parallel symmetrical side walls, a plurality of serially arranged steps that may produce predetermined recycling action, and a housing mounted on the two side walls, wherein, each of the two side walls has one opposite side pre-fit with a cam groove and a chain guide groove each having a symmetrical track, each of the two side walls has two opposite ends pivoted with a shaft, each shaft is respectively secured with a sprocket located adjacent to an inner side of the side wall, a chain is mounted between two opposite sprockets, the chain is inserted into the sprocket guide groove of the side wall;

each of the steps has two end faces each provided with a protruding shaft and a retaining shaft respectively, the protruding shaft has a free end secured with a bearing, the bearing is inserted into the cam groove of the side wall to form a rolling state, the retaining shaft has an end portion combined with the chain at a position with a preset span, the two chains are driven by a driver, so that each of the steps produce a predetermined movement with the track of the cam groove and the chain guide groove, thereby forming a stepwise slope region, and a smooth platform region.

The chain guide groove is formed with a flange extended toward a bottom edge of the chain, and the bottom edge of the chain is rested on the flange.

Each of the steps has a surface provided with a plurality of transversely extended insert blocks and recesses so that the steps can be inserted with each other, and the housing defines a plurality of recesses at predetermined positions so that the insert blocks on the surface of the steps are inserted into and slide in the recesses of the housing.

Further benefits and advantages of the present invention will become apparent after a careful reading of the detailed description with appropriate reference to the accompanying drawings.

DETAILED DESCRIPTION OF THE INVENTION

Figure 1:
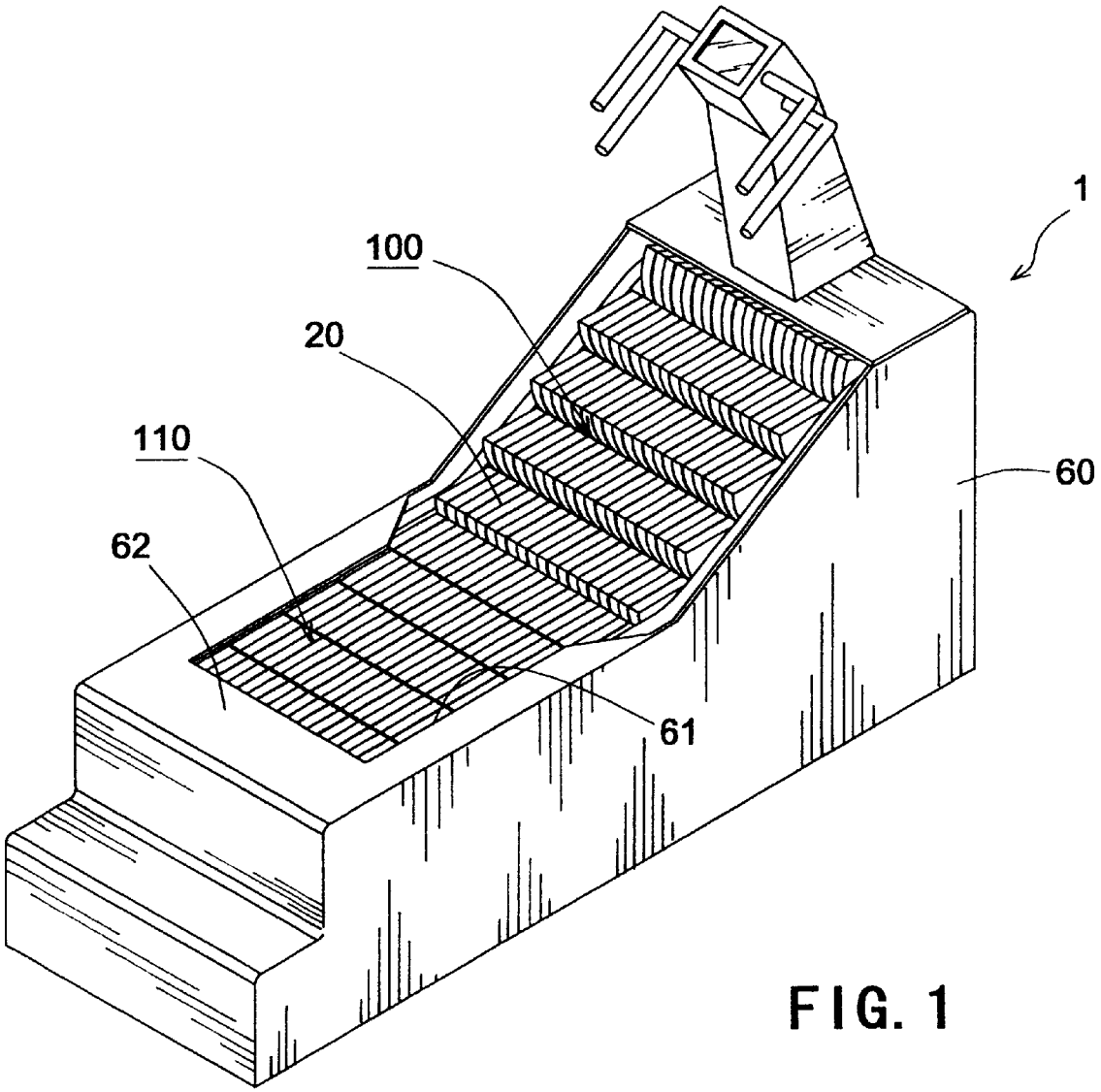
FIG. 1 is a perspective view of a tread exercising machine in accordance with the present invention.
Figure 2:
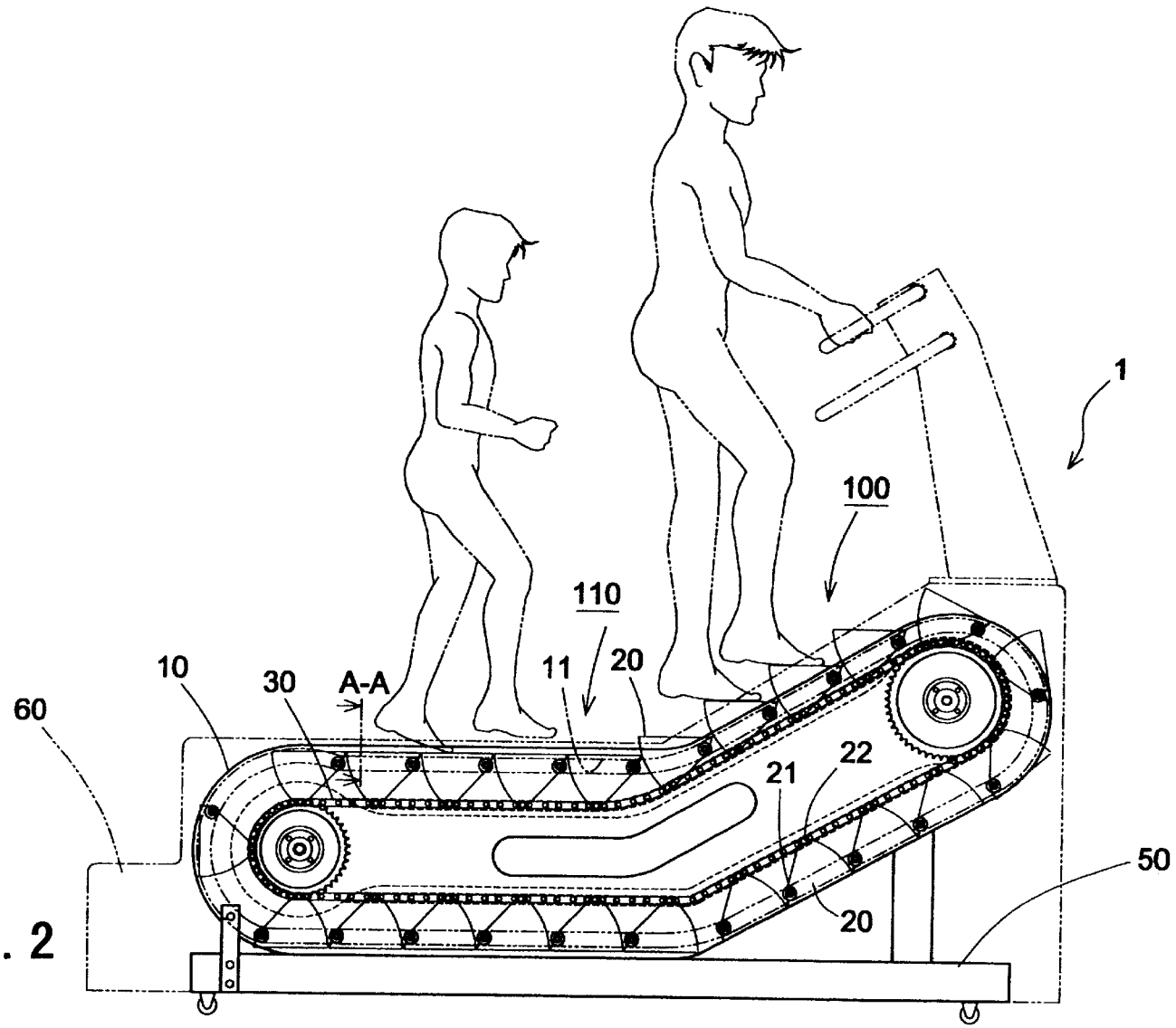
FIG. 2 is a side plan schematic view of the tread exercising machine as shown in FIG. 1.
Figure 3:
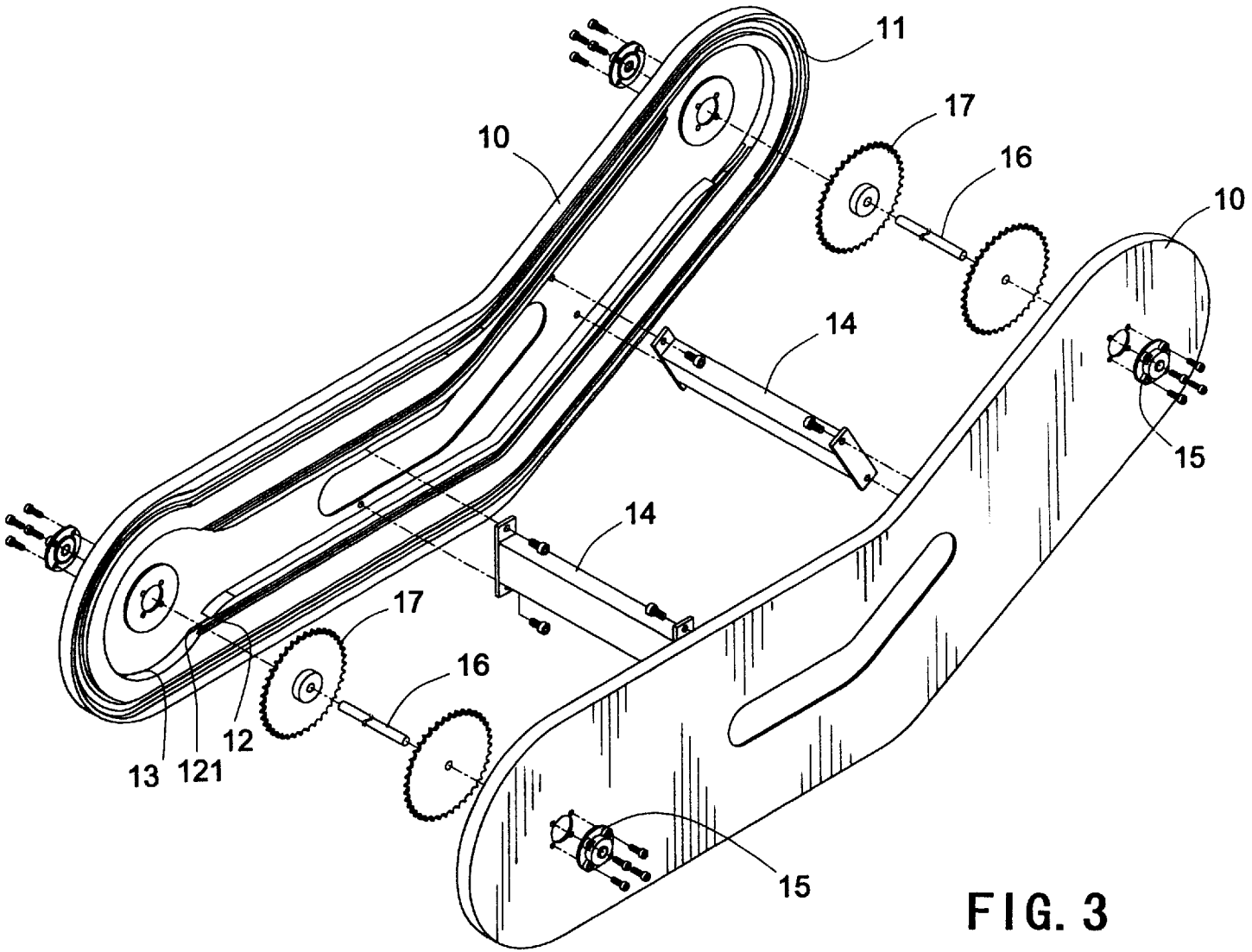
FIG. 3 is a partially exploded perspective view of the tread exercising machine as shown in FIG. 1.

Referring to the drawings and initially to FIGS. 1–3, a tread exercising machine 1 in accordance with the present invention comprises two parallel symmetrical side walls 10, a plurality of serially arranged steps 20 that may produce predetermined recycling action, and a housing 60 mounted on the two side walls 10.

Figure 4:
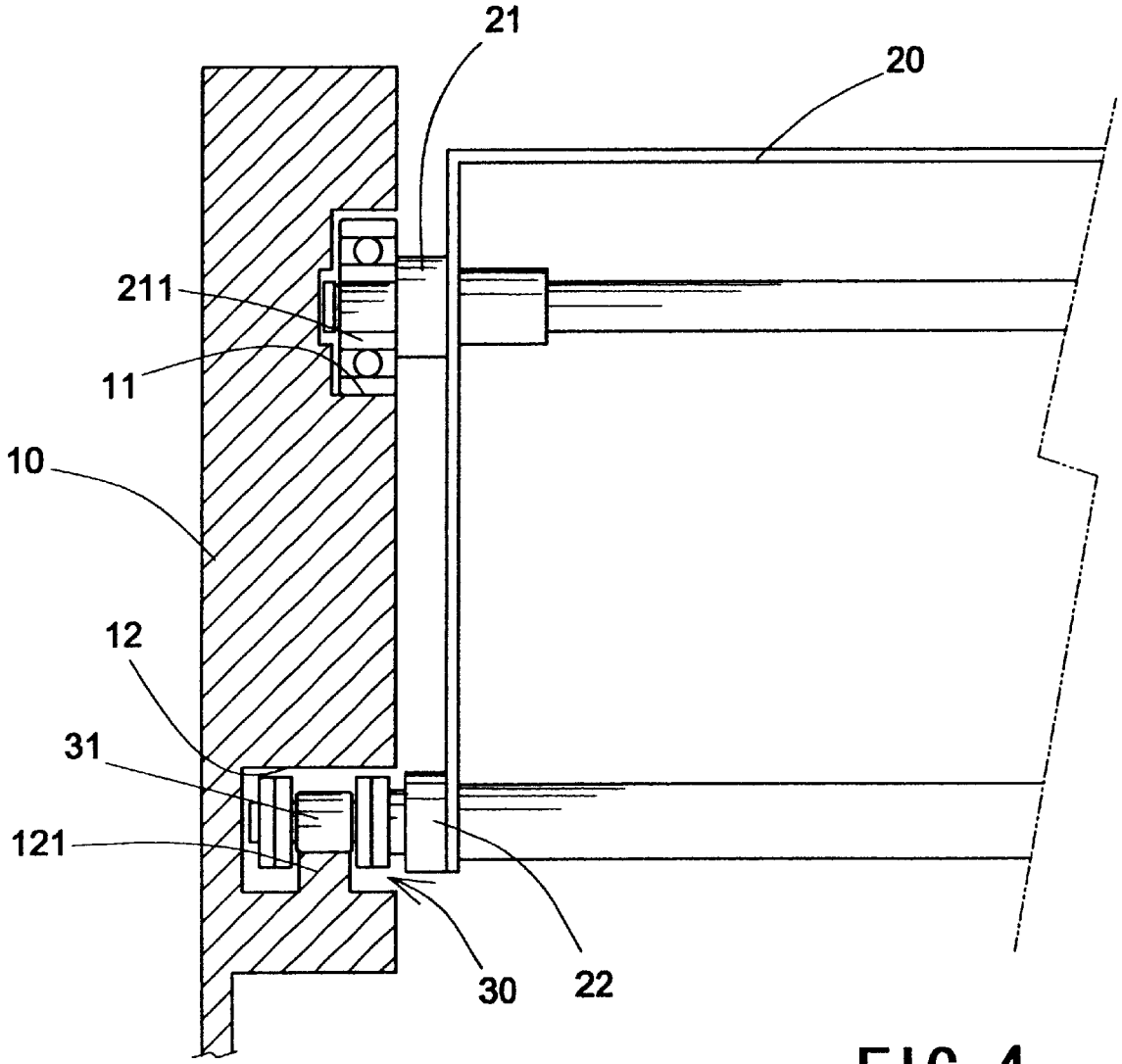
FIG. 4 is a cross-sectional schematic view showing combination of the step and the side wall of the tread exercising machine as shown in FIG. 1.
Figure 5:
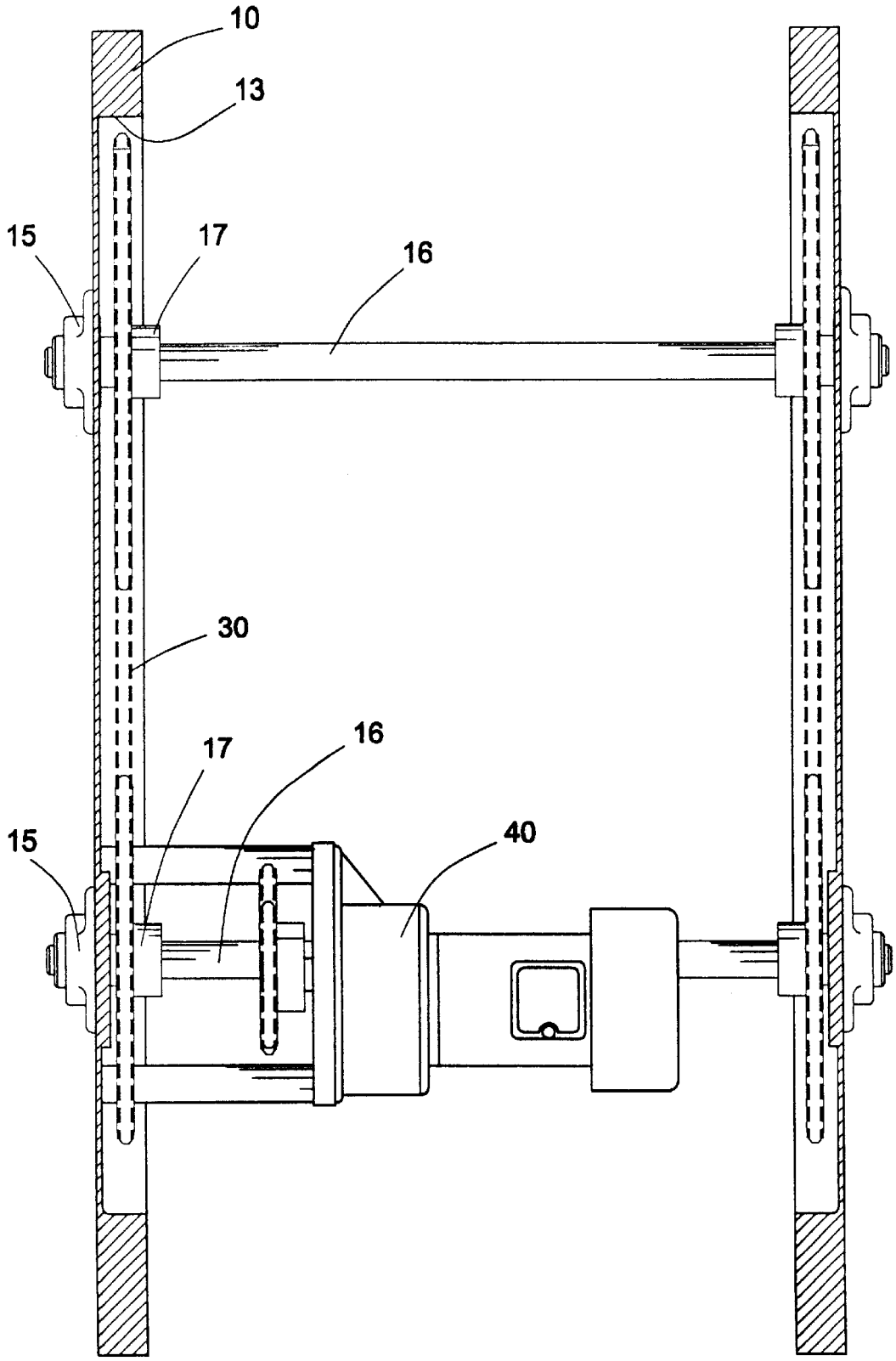
FIG. 5 is a top plan cross-sectional view of the tread exercising machine as shown in FIG. 1.
Figure 6:
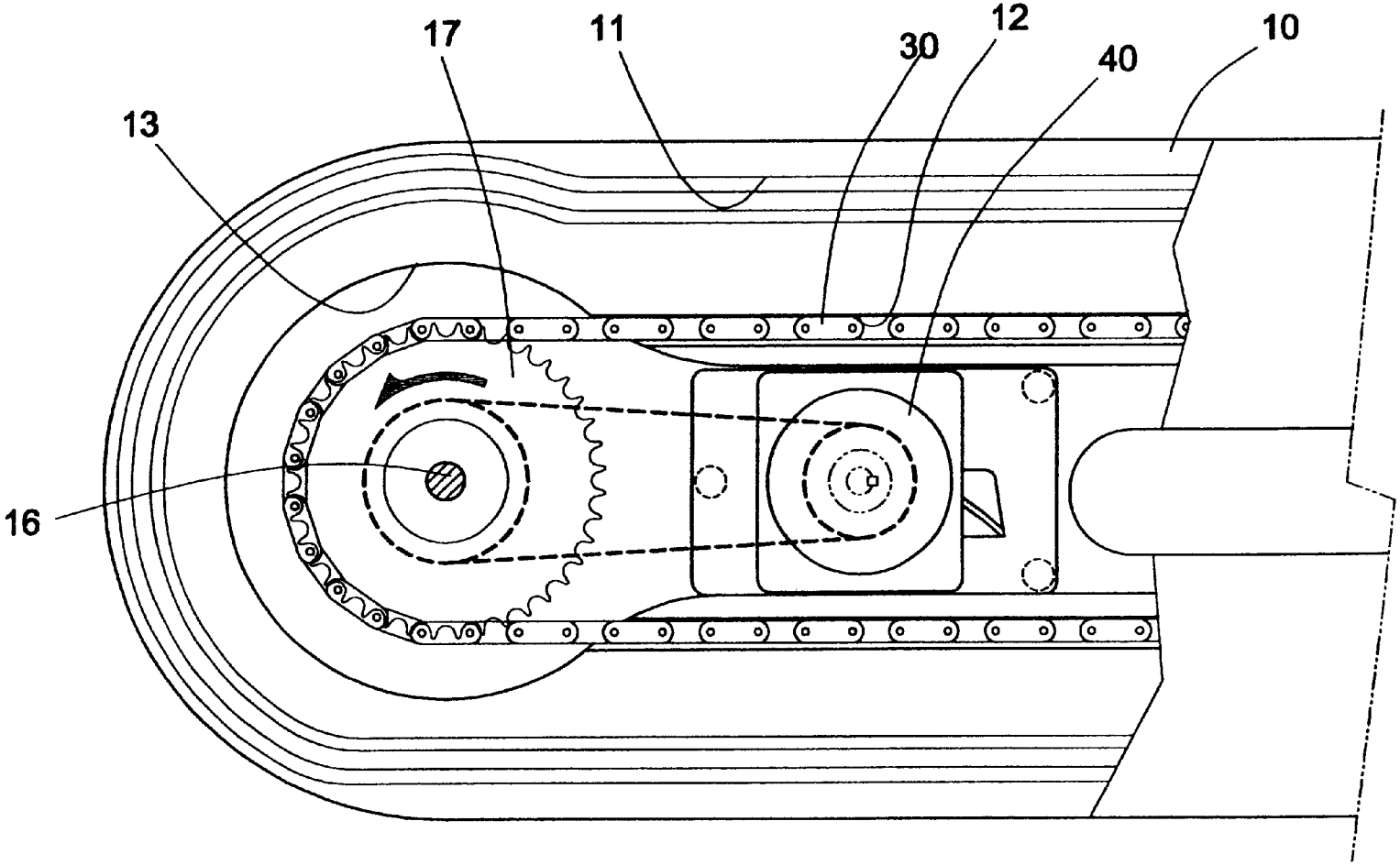
FIG. 6 is a partially cut-away side plan schematic view of the tread exercising machine as shown in FIG. 1.

As shown in FIG. 3, the two side walls 10 are symmetrical with each other. Each side wall 10 has two ends each having a circular shape, and one end of the side wall 10 is tilt in an oblique manner. A plurality of support rods 14 are supported between the two side walls 10. Each side walls 10 has a bottom secured on a base 50 as shown in FIG. 2. Each of the two ends of each side wall 10 defines a receiving chamber 13. Each of the two side walls 10 has a side having an outer rim defining a closed cam groove 11 and an inner rim defining two chain guide grooves 12 having predetermined tracks. Each of the two ends of each chain guide groove 12 communicates with the receiving chamber 13. A side face of the chain guide groove 12 opposite to the base 50 is formed with a flange 121. Each of the two ends of the side walls 10 is secured with a bearing seat 15. A shaft 16 is pivoted between two opposite bearing seats 15. Each shaft 16 is respectively secured with a sprocket 17 which is received in the receiving chamber 13 of the side wall 10. A chain 30 is mounted between two opposite sprockets 17, and each chain 30 is inserted into the sprocket guide groove 12 of the side wall 10. The sleeve ring 31 on the chain 30 has a bottom edge rested on the top edge of the flange 121 as shown in FIG. 4. A driver 40 is secured on one side wall 10 at a predetermined position as shown in FIGS. 5 and 6, for driving the shafts 16 pivoted on the side walls 10 to rotate.

Figure 7:
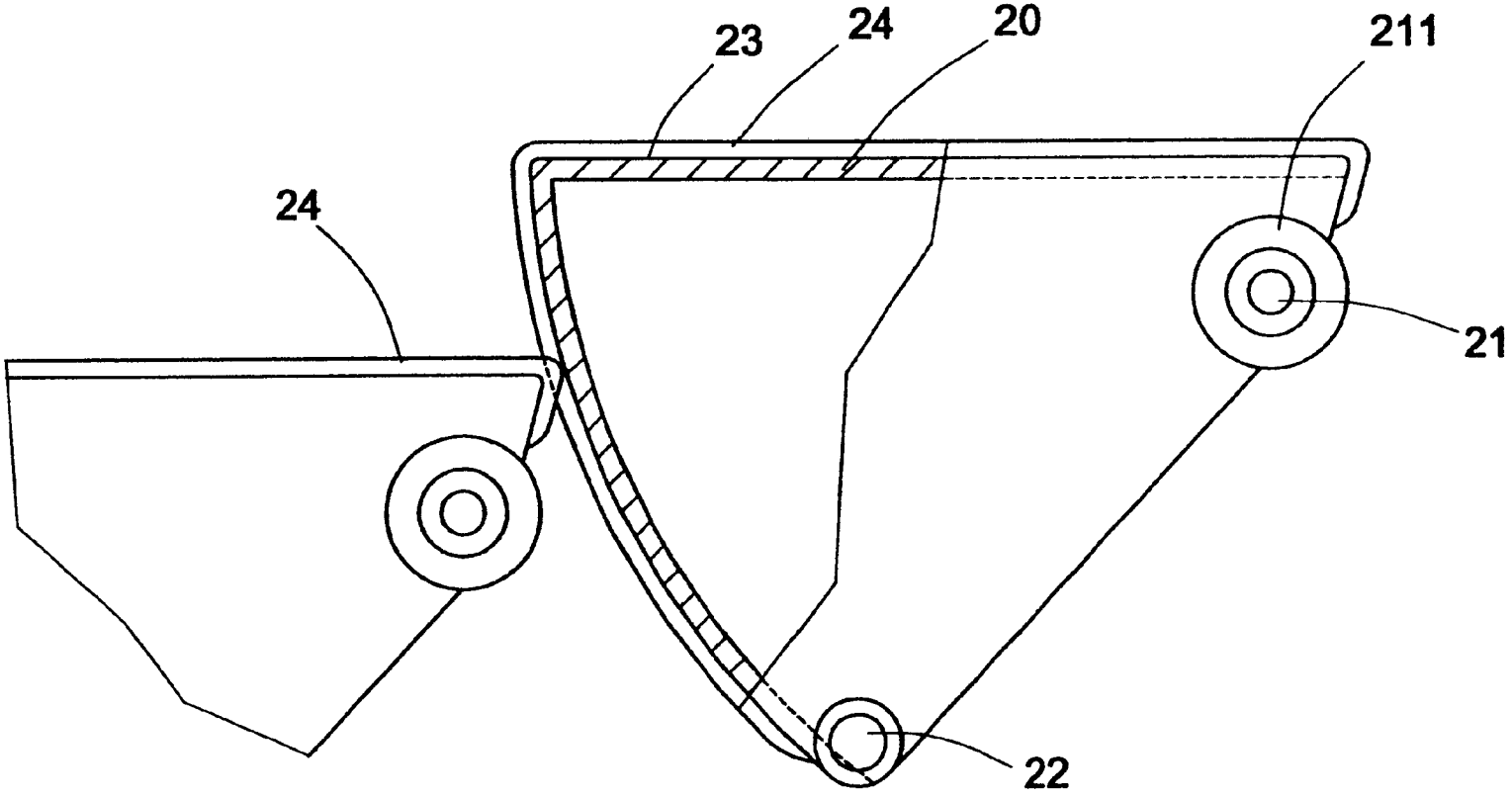
FIG. 7 is a cross-sectional schematic view showing combination of two steps of the tread exercising machine as shown in FIG. 1.

Each of the plurality of serially arranged steps 20 mounted between the two side walls 10 has a sector shape. Each of the steps 20 has two end faces each provided with a protruding shaft 21 and a retaining shaft 22 respectively as shown in FIG. 4. The protruding shaft 21 has a free end secured with a bearing 211. The bearing 211 is inserted into the cam groove 11 of the side wall 10 to form a rolling state. The retaining shaft 22 at each of the two ends of the steps 20 has an end portion combined with the chain 30 at a position with a preset span. The two chains 30 are driven by the driver 40, so that each of the steps 20 is moved with rotation of the chain 30 to produce a predetermined movement with the displacement track of the cam groove 11 and the chain guide groove 12 of the side wall 10, thereby forming a stepwise slope region 100, and a smooth platform region 110 as shown in FIG. 2. Each of the steps 20 has a surface provided with a plurality of transversely extended insert blocks 24 and recesses 23 as shown in FIG. 7 so that the steps 20 can be inserted with each other so as to form a positioning state, thereby preventing rightward and leftward movement.

Figure 8:
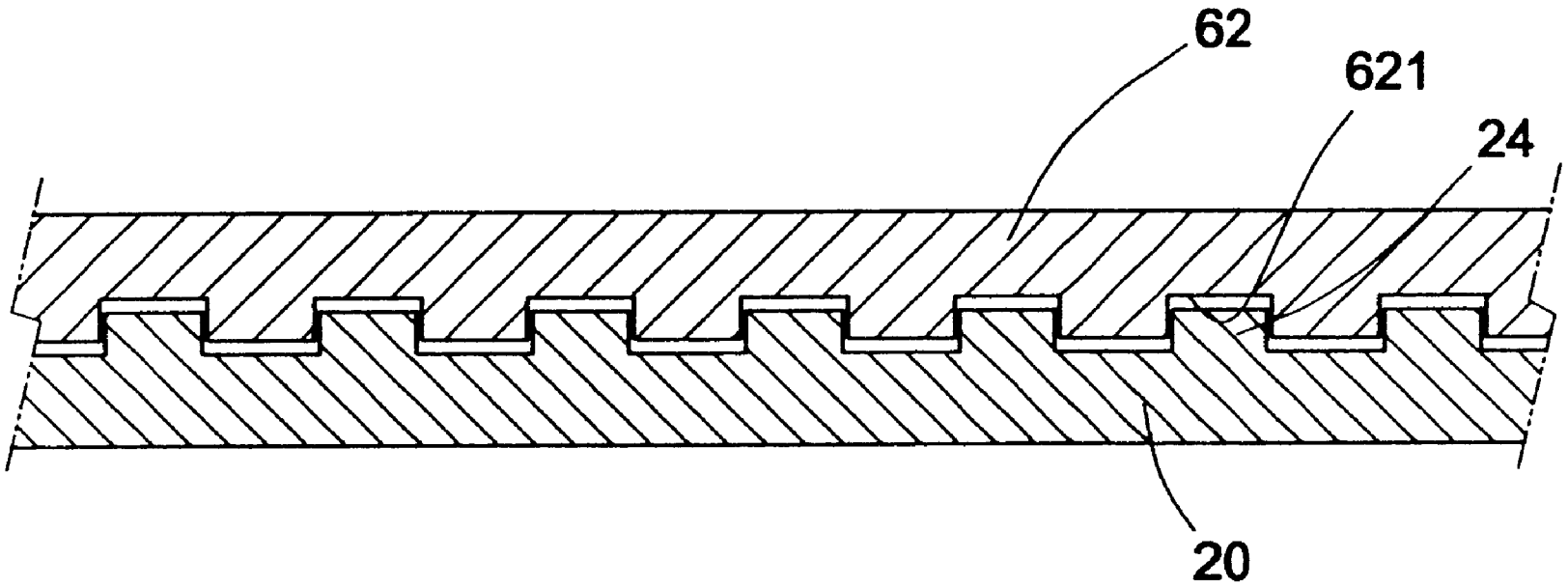
FIG. 8 is a cross-sectional schematic view of the tread exercising machine along line A—A as shown in FIG. 2.

The housing 60 is mounted on the side walls 10 and the steps 20, and defines an opening 61 opposite to the slope region 100 and the platform region 110, thereby exposing the slope region 100 and the platform region 110 as shown in FIG. 1. The housing 60 has one end provided with a covering plate 62 having an inner side defining a plurality of recesses 621 at predetermined positions so that the insert blocks 24 on the surface of the steps 20 are inserted into and slide in the recesses 621 of the housing 60 as shown in FIG. 8.

As shown in FIG. 2, when the driver 40 in the tread exercising machine 1 is operated, the sprocket 17 on the shaft 16 and the chain 30 are driven to rotate. The two chains 30 drive the retaining shaft 22 at the two ends of each step 20 to move. The bearing 211 on the protruding shaft 21 of each step 20 produces a predetermined displacement along the track in the cam groove 11 of the side wall 10, whereby, when each step 20 is moved in the slope region 100, the steps 20 form a plurality of stepwise steps which are moved downward toward the platform region 110. Each step 20 gradually forms a flat and smooth state when approaching the platform region 110, and is continuously moved toward the covering plate 62 of the housing 60, and are then hidden under the covering plate 62 of the housing 60 as shown in FIGS. 1 and 2. In such a manner, the user can perform a tread movement such as climbing the mountain, climbing the ladder or the like in the slope region 100, and can also perform a slower movement such as walking or the like in the platform region 110. The tread exercising machine 1 of the present invention can be used to simultaneously allow multiple users to perform the mountain climbing and walking movement as shown in FIG. 2. The end face of each step 20 is provided with a protruding shaft 21 and a retaining shaft 22. The protruding shaft 21 is secured with a bearing 21 that is inserted into the cam groove 11 of the side wall 10 to roll therein. The retaining shaft 22 is driven by the chain 30. Thus, the protruding shaft 21 and retaining shaft 22 of each step 20 are respectively moved in the cam groove 11 and the chain guide groove 12 of the side wall 10, whereby each step 20 can be moved fluently along the predetermined track, thereby preventing from incurring the phenomenon of interference.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A tread exercising machine comprising: two parallel symmetrical side walls (10), a plurality of serially arranged steps (20) that may produce predetermined recycling action, and a housing (60) mounted on said two side walls (10), wherein, each of said two side walls (10) has one opposite side pre-fit with a cam groove (11) and a chain guide groove (12) each having a symmetrical track, each of said two side walls (10) has two opposite ends pivoted with a shaft (16), each shaft (16) is respectively secured with a sprocket (17) located adjacent to an inner side of said side wall (10), a chain (30) is mounted between two opposite chain (17), said chain (30) is inserted into said chain guide groove (12) of said side wall (10);

each of said steps (20) has two end faces each provided with a protruding shaft (21) and a retaining shaft (22) respectively, said protruding shaft (21) has a free end secured with a bearing (211), said bearing (211) is inserted into said cam groove (11) of said side wall (10) to form a rolling state, said retaining shaft (22) has an end portion combined with said chain (30) at a position with a preset span, said two chains (30) are driven by a driver (40), so that each of said steps (20) produce a predetermined movement with said track of said cam groove (11) and said chain guide groove (12), thereby forming a stepwise slope region (100), and a smooth platform region (110).

2. The tread exercising machine in accordance with claim 1, wherein said chain guide groove (12) is formed with a flange (121) extended toward a bottom edge of said chain (30), and said bottom edge of said chain (30) is rested on said flange (121).

3. The tread exercising machine in accordance with claim 1, wherein each of said steps (20) has a surface provided with a plurality of transversely extended insert blocks (24) and recesses (23) so that said steps (20) can be inserted with each other, and said housing (60) defines a plurality of recesses (621) at predetermined positions so that said insert blocks (24) on said surface of said steps (20) are inserted into and slide in said recesses (621) of said housing (60).

* * * * *